US008350474B2

(12) United States Patent
Ota et al.

(10) Patent No.: US 8,350,474 B2
(45) Date of Patent: Jan. 8, 2013

(54) PLASMA DISPLAY PANEL HAVING A DIELECTRIC LAYER

(75) Inventors: Yoshiyuki Ota, Osaka (JP); Kazuhiro Morioka, Kyoto (JP); Akira Kawase, Hyogo (JP); Morio Fujitani, Osaka (JP); Tatsuo Mifune, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 13/129,229

(22) PCT Filed: Dec. 17, 2010

(86) PCT No.: PCT/JP2010/007329

§ 371 (c)(1),
(2), (4) Date: May 13, 2011

(87) PCT Pub. No.: WO2011/080886

PCT Pub. Date: Jul. 7, 2011

(65) Prior Publication Data

US 2011/0285281 A1 Nov. 24, 2011

(30) Foreign Application Priority Data

Dec. 28, 2009 (JP) ..... 2009-297394
Jan. 8, 2010 (JP) ..... 2010-002519

(51) Int. Cl.
*H01J 17/49* (2006.01)
*H01J 11/02* (2006.01)

(52) U.S. Cl. ..... 313/586; 313/582; 313/584; 313/587; 501/72; 501/73

(58) Field of Classification Search ..... 313/582–587
See application file for complete search history.

(56) References Cited

U.S. PATENT DOCUMENTS

| | | | | |
|---|---|---|---|---|
| 7,057,342 | B2 * | 6/2006 | Aoki et al. | 313/583 |
| 7,834,551 | B2 * | 11/2010 | Hasegawa et al. | 313/586 |
| 2004/0224834 | A1 * | 11/2004 | Kohli | 501/70 |
| 2007/0236147 | A1 | 10/2007 | Onoda | |
| 2008/0085423 | A1 * | 4/2008 | Kwon | 428/702 |
| 2009/0004366 | A1 | 1/2009 | Onoda et al. | |
| 2009/0143214 | A1 * | 6/2009 | Niida et al. | 501/56 |

(Continued)

FOREIGN PATENT DOCUMENTS

JP 2003-128430 5/2003

(Continued)

OTHER PUBLICATIONS

International Search Report issued Jan. 18, 2011 in International (PCT) Application No. PCT/JP2010/007329.

*Primary Examiner* — Sikha Roy
(74) *Attorney, Agent, or Firm* — Wenderoth, Lind & Ponack, L.L.P.

(57) ABSTRACT

A plasma display panel includes a front plate and a rear plate disposed in such a manner as to face the front plate. The front plate has a display electrode and a dielectric layer covering the display electrode. The dielectric layer contains substantially no lead components but contains MgO, $SiO_2$, and $K_2O$. A content of MgO is in a range between 0.3 mol % and 1.0 mol %, both inclusive. The content of $SiO_2$ is in a range between 35 mol % and 50 mol %, both inclusive.

8 Claims, 3 Drawing Sheets

U.S. PATENT DOCUMENTS

| | | | | |
|---|---|---|---|---|
| 2009/0253567 | A1* | 10/2009 | Nagai et al. | 501/70 |
| 2011/0263409 | A1* | 10/2011 | Oshita et al. | 501/64 |

FOREIGN PATENT DOCUMENTS

| | | |
|---|---|---|
| JP | 2007-297265 | 11/2007 |
| JP | 2008-19145 | 1/2008 |
| JP | 2008-201595 | 9/2008 |
| JP | 2008-201596 | 9/2008 |
| JP | 2008-201597 | 9/2008 |
| JP | 2009-21205 | 1/2009 |
| JP | 2009-35471 | 2/2009 |
| JP | 2010-132462 | 6/2010 |
| WO | 2008/099916 | 8/2008 |
| WO | 2008/117535 | 10/2008 |
| WO | WO 2010067498 A1 * | 6/2010 |

* cited by examiner

PLASMA DISPLAY PANEL HAVING A DIELECTRIC LAYER

TECHNICAL FIELD

A technology disclosed in the present description relates to a plasma display panel used in a display device etc.

BACKGROUND ART

As a dielectric layer of a plasma display panel (hereinafter abbreviated as PDP), low melting glass mainly containing lead oxide has been used. Recently, the dielectric layer containing no lead components out of consideration to environments has been disclosed (for example, refer to Patent Document 1).

PRIOR ART DOCUMENT

Patent Document

Patent Document 1: Unexamined Japanese Patent Publication No. 2003-128430

DISCLOSURE OF THE INVENTION

A plasma display panel includes a front plate and a rear plate disposed to face the front plate. The front plate has a display electrode and a dielectric layer which covers the display electrode. The dielectric layer contains no lead components substantially but contains magnesium oxide (MgO), silicon dioxide ($SiO_2$), and potassium oxide ($K_2O$). A content of MgO in the dielectric layer is in a range between 0.3 mol % and 1.0 mol %, both inclusive. The content of $SiO_2$ in the dielectric layer is in a range between 35 mol % and 50 mol %.

PREFERRED EMBODIMENTS FOR CARRYING OUT OF THE INVENTION

1. Outline of PDP 1

Figure 1:
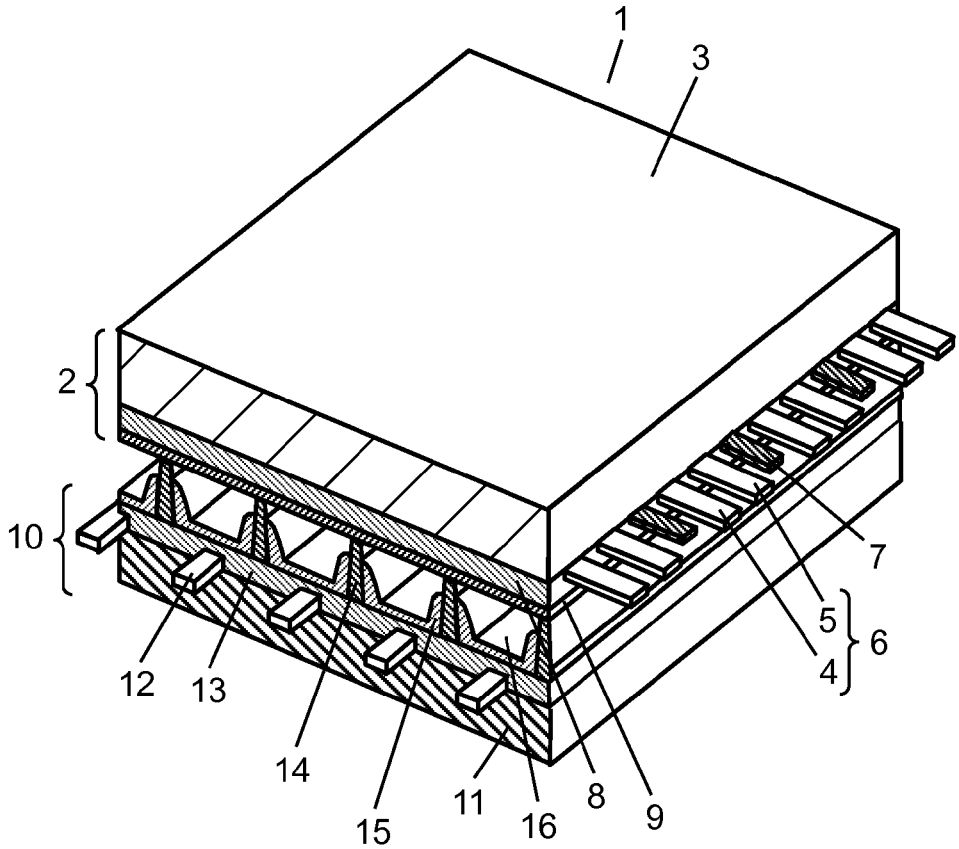
FIG. 1 is a perspective view showing a structure of a PDP.

PDP 1 in the present embodiment is an AC surface discharge type PDP. As shown in FIG. 1, PDP 1 includes front plate 2 constituted of front glass substrate 3 etc. and facing rear plate 10 constituted of rear glass substrate 11 etc. Front plate 2 and rear plate 10 each have its outer circumferential portion air-tightly sealed with a sealing material made of glass frit. In discharge space 16 in the sealed PDP 1, a discharge gas such as neon (Ne) or Xenon (Xe) is contained with a pressure of 55 kPa (400 Torr) through 80 kPa (600 Torr).

On front glass substrate 3, a plurality of pairs of stripe-shaped display electrodes 6 each constituted of scan electrode 4 and sustain electrode 5 and black stripes (light shielding layers) 7 are alternately disposed in parallel with each other.

On front glass substrate 3, dielectric layer 8 is formed in such a manner as to cover display electrode 6 and black stripe 7 and acting as a capacitor. Further, on a surface of dielectric layer 8, protective layer 9 made of magnesium oxide (MgO) is formed.

Scan electrode 4 and sustain electrode 5 are stacks in which a bus electrode made of Ag is stacked on a transparent electrode made of a conductive metal oxide such as indium tin oxide (ITO), tin oxide ($SnO_2$), or zinc oxide (ZnO).

On rear glass substrate 11, a plurality of address electrodes 12 made of a conducting material mainly containing silver (Ag) is disposed in parallel with each other in a direction perpendicular to display electrode 6. Address electrodes 12 are covered by base dielectric layer 13. Further, on base dielectric layer 13, barrier rib 14 having a predetermined height is formed between address electrodes 12, to partition discharge space 16. In trenches between barrier ribs 14, each of phosphor layer 15 emitting red light, phosphor layer 15 emitting green light, and phosphor layer 15 emitting blue light when irradiated with ultraviolet light is applied and formed in sequence for each of address electrodes 12. A discharge cell is formed at an intersection of display electrode 6 and address electrode 12. The discharge cell having the red, green, and blue phosphor layers 15 arranged in the direction of display electrode 6 serves as a pixel for color display.

It is to be noted that in the present embodiment, the discharge gas sealed in discharge space 16 contains 10-30% by volume of Xe.

Figure 2:
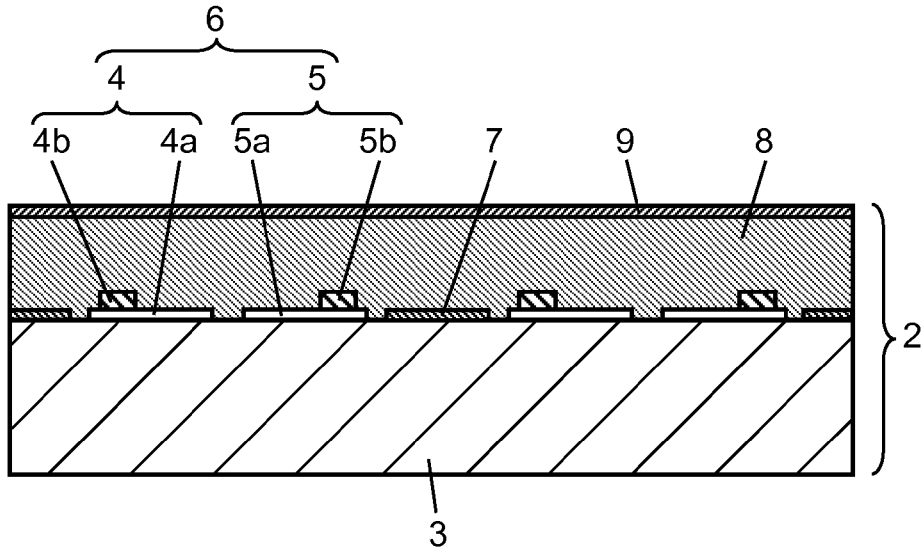
FIG. 2 is a cross-sectional view showing a structure of a front plate.

FIG. 2 is given by top-and-bottom reversing FIG. 1. As shown in FIG. 2, on front glass substrate 3 manufactured by the float process, a pattern of display electrode 6 including scan electrode 4 and sustain electrode 5 and a pattern of black stripe 7 are formed. Scan electrode 4 and sustain electrode 5 are constituted of transparent electrodes 4*a* and 5*a* made of indium tin oxide (ITO) and tin oxide ($SnO_2$) and metal bus electrodes 4*b* and 5*b* formed on transparent electrodes 4*a* and 5*a*, respectively. Metal bus electrodes 4*b* and 5*b* are made of a conducting material mainly containing silver (Ag) and used for a purpose of giving conductivity in a longer direction of transparent electrodes 4*a* and 5*a*.

2. Method for Manufacturing PDP 1

2-1. Method for Manufacturing Front Plate 2

Scan electrode 4, sustain electrode 5, and black stripe 7 are formed on front glass substrate 3. Transparent electrodes 4*a* and 5*a* and metal bus electrodes 4*b* and 5*b* are formed by photolithography. As materials of metal bus electrodes 4*b* and 5*b*, an electrode paste is used which contains silver (Ag), a glass frit intended to bind silver (Ag), a photosensitive resin, and a solvent. First, the electrode paste is applied to front glass substrate 3 by screen printing. Next, the solvent in the electrode paste is removed using a baking oven. Next, the electrode paste is exposed to light via a photo mask having a predetermined pattern.

Next, the electrode paste is developed, to form a bus electrode pattern. Finally, a pattern of the bus electrodes is baked at a predetermined temperature using a baking oven. That is, the photosensitive resin in the electrode pattern is removed. Further, the glass frit in the electrode pattern is melted and solidifies again. Similarly, black stripe 7 is formed. As a material of black stripe 7, a paste containing a black pigment is used.

Next, dielectric layer 8 is formed. As a material of dielectric layer 8, a dielectric paste is used which contains a dielectric glass and a binder component (resin, solvent). First, the dielectric paste is applied by die coating etc. onto front glass substrate 3 in such a manner as to cover scan electrode 4, sustain electrode 5, and black stripe 7 up to a predetermined thickness. Next, the solvent in the dielectric paste is removed using the baking oven. Finally, the dielectric paste is baked at a temperature of about 450-600° C. using the baking oven. That is, the resin in the dielectric paste is removed. Further, the dielectric glass is melted and solidifies again. Through those processes, dielectric layer 8 is formed. That is, the components other than the dielectric glass are removed by drying and baking from the dielectric paste, which contains the dielectric glass as well as the resin, the solvent, etc. Therefore, dielectric layer 8 is composed substantially of the dielectric glass.

It is to be noted that besides the method of die coating the dielectric paste, screen printing, spin coating, etc. can be used. Further, instead of using the dielectric paste, chemical vapor deposition (CVD) etc. can be used to form a film that serves as dielectric layer 8.

Next, protective layer 9 made of magnesium oxide (MgO) etc. is formed on dielectric layer 8.

Through those processes, scan electrode 4, sustain electrode 5, black stripe 7, dielectric layer 8, and protective layer 9 are formed on front glass substrate 3, completing front plate 2.

2-2. Method for Manufacturing Rear Plate 10

Address electrode 12 is formed on rear glass substrate 11 by photolithography. As a material of the address electrode, an address electrode paste is used which contains silver (Ag) intended to ensure conductivity, a glass frit intended to bind silver (Ag), a photosensitive resin, and a solvent. First, the address electrode paste is applied by screen printing etc. onto rear glass substrate 11 up to a predetermined thickness. Next, the solvent in the address electrode paste is removed using the baking oven. Next, the address electrode paste is exposed to light via a photo mask having a predetermined pattern. Next, the address electrode paste is developed, to form an address electrode pattern. Finally, the address electrode pattern is baked at a predetermined temperature using the baking oven. In other words, the photosensitive resin is removed from the address electrode pattern. Further, the glass frit in the address electrode pattern is melted and solidifies again. Through those processes, address electrode 12 is formed. It is to be noted that besides the method for screen printing the address electrode paste, sputtering, vapor deposition, etc. can be used.

Next, base dielectric layer 13 is formed. As a material of base dielectric layer 13, a base dielectric paste is used which contains a dielectric glass frit, a resin, and a solvent. First, the base dielectric paste is applied by screen printing etc. in such a manner as to cover address electrode 12 onto rear glass substrate 11 on which address electrode 12 is formed to the predetermined thickness. Next, the solvent in the base dielectric paste is removed using the baking oven. Finally, the base dielectric paste is baked at a predetermined temperature using the baking oven. That is, the resin in the base dielectric paste is removed. Further, the dielectric glass frit is melted and solidifies again. Through those processes, base dielectric layer 13 is formed. It is to be noted that besides the method for screen printing the base dielectric paste, die coating, spin coating, etc. can be used. Further, instead of using the base dielectric paste, chemical vapor deposition (CVD) etc. can be used to form a film that serves as base dielectric layer 13.

Next, barrier rib 14 is formed using photolithography. As a material of barrier rib 14, a barrier rib paste is used which contains filler, a glass frit intended to bind the filler, a photosensitive resin, a solvent, etc. First, the barrier rib paste is applied by die coating etc. onto base dielectric layer 13 to a predetermined thickness. Next, the solvent in the barrier rib paste is removed using the baking oven. Next, the barrier rib is exposed to light via a photo mask having a predetermined pattern. Next, the barrier rib paste is developed, to form a barrier rib pattern. Finally, the barrier rib pattern is baked at a predetermined temperature using the baking oven. That is, the photosensitive resin in the barrier rib pattern is removed. Further, the glass frit in the barrier rib pattern is melted and solidifies again. Through those processes, barrier rib 14 is formed. It is to be noted that besides photolithography, sandblasting etc. can be used.

Next, phosphor layer 15 is formed. As a material of phosphor layer 15, a phosphor paste is used which contains phosphor particles, a binder, a solvent, etc. First, the phosphor paste is applied by dispensing etc. onto base dielectric layer 13 between neighboring barrier ribs 14 and side faces of barrier rib 14 up to a predetermined thickness. Next, the solvent in the phosphor paste is removed using the baking oven. Finally, the phosphor paste is baked at a predetermined temperature using the baking oven. That is, the resin in the phosphor paste is removed. Through those processes, phosphor layer 15 is formed. It is to be noted that besides dispensing, screen printing etc. can be used.

Through those processes, rear plate 10 having the predetermined members on rear glass substrate 11 is completed.

2-3. Method for Assembling Front Plate 2 and Rear Plate 10

First, front plate 2 and rear plate 10 are disposed face to face in such a manner that display electrode 6 and address electrode 12 cross each other perpendicularly. Next, front plate 2 and rear plate 10 each have its outer circumferential portion sealed with glass frit. Next, a discharge gas containing Ne, Xe, etc. is sealed into discharge space 16, thereby completing PDP 1.

3. Details of Dielectric Layer 8

Recently, a PDP has been desired to be of a higher definition. The higher-definition PDP has an increased number of scan lines and hence an increased number of display electrodes. That is, it has a decreased distance between the display electrodes. This accelerates diffusion of silver ions from a silver electrode constituting the display electrode into the dielectric layer or the glass substrate. If the silver ions are diffused into the dielectric layer or the glass substrate, alkaline metal ions contained in the dielectric layer or divalent tin ions contained in the glass substrate have a reduction action, to form silver colloid. As a result, the dielectric layer and the glass substrate are yellowed or tanned greatly and silver oxide gives oxygen owing to the reduction action, thereby giving rise to air bubbles in the dielectric layer.

Therefore, an increase in number of the scan lines accelerates yellowing of the glass substrate and production of the air bubbles in the dielectric layer, thereby significantly damaging an image quality and giving rise to poor insulation.

However, a conventional dielectric layer provided out of consideration for environmental so that it may contain no lead components has been suffering from a problem in that it cannot meet requirements to inhibit both yellowing and poor insulation in itself.

The technology disclosed in the present embodiment will solve those problems and so can realize a PDP that insures a high luminance and high reliabilities even with high definition display, further taking into account the environmental problems.

Dielectric layer 8 is desired to have a high withstand voltage and also a high light transmittance. Those properties greatly depend on a composition of dielectric layer 8.

Conventionally, the dielectric paste has been baked at roughly 450-600° C. and so contained at least 20% by weight of lead oxide in the dielectric glass. However, out of consideration for the environments, the dielectric glass contains substantially no lead components but does it contain about 0.5-40% by weight of bismuth oxide ($Bi_2O_3$).

If a content of $Bi_2O_3$ in the dielectric glass increases, a softening point of the dielectric glass lowers. A decrease in softening point of the dielectric glass has a variety of advantages in manufacturing processes. However, since bismuth (Bi)-based materials are expensive, an increase in amount of the additive of $Bi_2O_3$ increases costs of the raw materials to be used. To solve the problem, a technology is available to use an oxide of an alkaline metal selected from a group of lithium (Li), sodium (Na), potassium (K), rubidium (Rb), and cesium (Cs) as an alternative for the Bi-based materials. Further, Bi has an atomic weight of 209. The larger the atomic weight is, the larger the density becomes. Therefore, it is difficult to realize a low-dielectric constant glass desired for improvements of the properties of the future PDPs. Therefore, it is necessary to reduce the content of a glass material having a large atomic weight.

3-1. Alkaline Metal Oxide

In the present embodiment, a dielectric glass contains potassium oxide ($K_2O$). Furthermore, in the present embodiment, the dielectric glass may further contain at least one of lithium oxide ($Li_2O$) and sodium oxide ($Na_2O$). This depends on the following reason. Front glass substrate 3 of a typical PDP contains $K_2O$ and $Na_2O$ a lot. Then, if dielectric layer 8 is baked at a high temperature of at least 550° C., alkaline metal ions ($Li^+$, $Na^+$, $K_+$) are exchanged between $K_2O$ and $Li_2O$ contained in the dielectric glass and $Na_2O$ contained in front glass substrate 3. However, $Li_+$, $Na_+$, and $K^+$ contribute to a thermal expansion coefficient of the glass substrate differently from each other. Therefore, if the ion exchange process occurs in baking of dielectric layer 8, a difference occurs between a thermal shrinkage of front glass substrate 3 in the vicinity of dielectric layer 8 and that of a portion of front glass substrate 3 not in the vicinity of dielectric layer 8, resulting in a large warp in front glass substrate 3 on which dielectric layer 8 is formed.

In contrast, in a case where the dielectric glass contains $K_2O$ as in the present embodiment, even if the aforesaid ion exchange process occurs, a difference is not liable to occur in thermal shrinkage, so that the warp in front glass substrate 3 can be inhibited. As a result, it is possible to reduce the content of $Bi_2O_3$ in the dielectric glass to 5 mol % or less. Further, it is also possible to reduce a warp in front glass substrate 3. In the following description, the content refers to that in the dielectric glass expressed in mol %, unless otherwise specified. That is, the content refers to that in dielectric layer 8.

Furthermore, the content of $K_2O$ should preferably be in a range between 6 mol % and 10 mol %, both inclusive. If the content of $K_2O$ is at least 6 mol %, the softening point of the dielectric glass can be lowered easily. On the other hand, if the content of $K_2O$ exceeds 10 mol %, strength of the dielectric layer deteriorates and its dielectric constant rises.

Furthermore, in a case where the dielectric glass contains $K_2O$ and, further, at least one of $Li_2O$ and $Na_2O$, in addition to inhibition of the warp in front glass substrate 3, the softening point of the dielectric glass can be lowered easily.

Moreover, the content of $Na_2O$ should preferably be in a range between 0.5 mol % and 3 mol %, both inclusive. If the content of $Na_2O$ increases, yellowing is liable to occur in front glass substrate 3 and dielectric layer 8. As a result of evaluation by the present inventors etc., it has been found that yellowing would be inhibited if the content of $Na_2O$ is 3 mol % or less. On the other hand, it has been found that if the content of $Na_2O$ is at least 0.5 mol %, the warp in front glass substrate 3 could be reduced.

Furthermore, more preferably the content of $K_2O$ should be larger than a sum of those of $Li_2O$ and $Na_2O$. This configuration enables inhibiting a change in thermal expansion coefficient of front glass substrate 3, thereby suppressing a large warp in front glass substrate 3.

3-2. Barium Component and Calcium Component

In the present embodiment, dielectric layer 8 substantially contains no barium (Ba) or calcium (Ca). This depends on the following reason.

A dielectric material is made by smashing each of materials with a wet jet mill or a ball mill (described in detail later). In this case, a Ba component and a Ca component are supplied in the shape of carbonates ($BaCO_3$, $CaCO_3$) as a raw material. Carbonic acid radicals contained in the carbonates are desorbed as a carbon dioxide gas during melting. However, there may be a case where a small amount of the carbon dioxide gas stay dissolved in the dielectric material.

Figure 3:
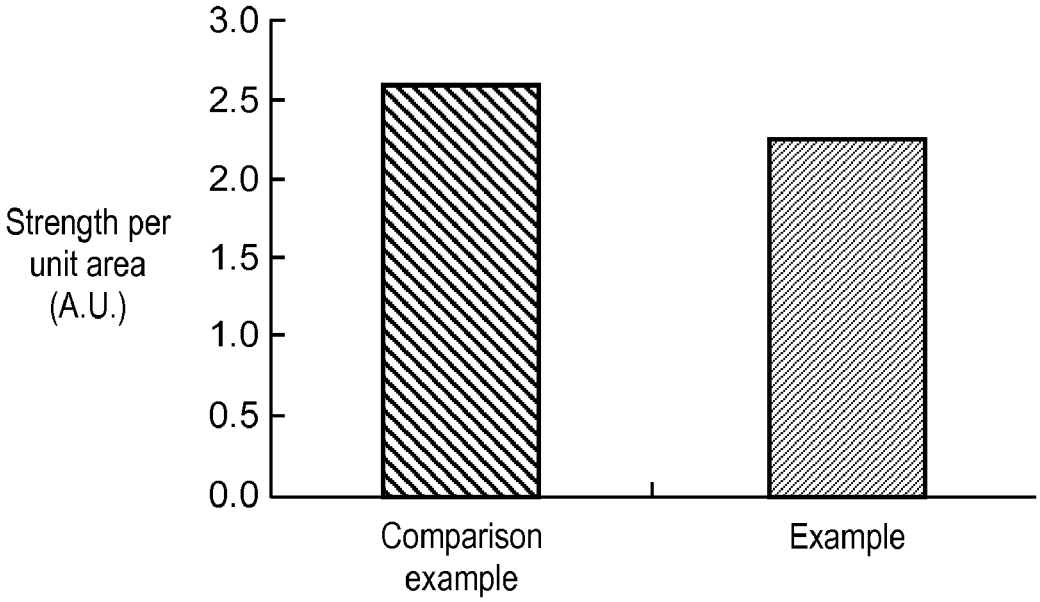
FIG. 3 is a graph showing a result of TDS measurement conducted on a dielectric layer.
Figure 4:
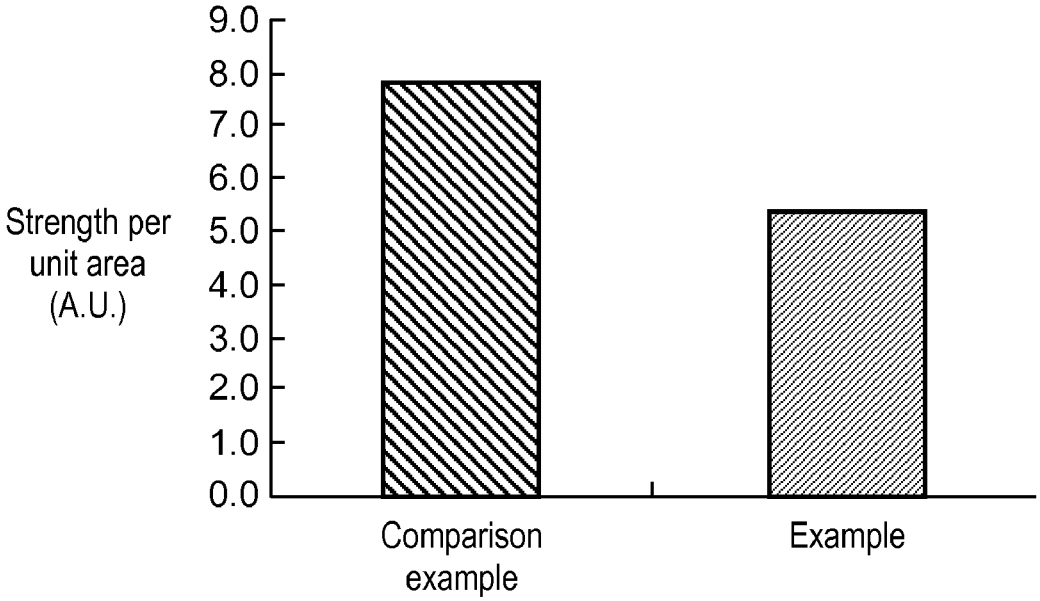
FIG. 4 is another graph showing the result of TDS measurement conducted on the dielectric layer.

FIGS. 3 and 4 show results of measurement on dielectric layer 8 by thermal desorption spectrometry (TDS). FIG. 3 shows strength per unit area of mass number 18 ($H_2O$). FIG. 4 shows strength per unit area of mass number 44 ($CO_2$). An example has a dielectric layer that substantially contains no Ba components or Ca components. A comparison example has a dielectric layer that contains 4 mol % of Ba and another 4 mol % of Ca.

In the TDS measurement, a WA1000S (made by ESCO, Ltd.) has been used. A pressure in a measurement chamber has been $1\times10^{-7}$ Pa. A measurement sample was cut into about 1-cm by 1-cm dice and arranged on a quartz stage placed in the chamber in such a manner that the dielectric layer faces upward. A quadrupole mass spectrometer used as a measurement device was placed over the chamber. The sample was heated using infrared rays. A temperature rose at a rate of 1° C./s. A temperature of the sample was measured using a thermocouple embedded in the quartz stage. The sample was heated from a room temperature to 900° C. An integral value of a strength value detected by the quadrupole mass spectrometer from the room temperature to 900° C. provides a strength per unit area.

FIGS. 3 and 4 show that if the Ba and Ca components are contained, $H_2O$ and $CO_2$ remain more in the dielectric layer. $H_2O$ and $CO_2$ are desorbed into the discharge space during discharge of the PDP, changing a drive voltage necessary for image display. This results in a gradual change in discharge drive voltage in a life test of the PDP, thereby deteriorating the image display quality.

To prevent such a trouble, dielectric layer 8 substantially contains no Ba or Ca components in the present embodiment.

3-3. MgO

As described above, $K_2O$, $Li_2O$, and $Na_2O$ can lower the softening point of the dielectric glass. On the other hand, an alkaline metal oxide represented by $K_2O$, $Li_2O$, and $Na_2O$ accelerate the reduction action of silver ions diffused from metal bus electrodes 4*b* and 5*b*. That is, silver colloid is formed more. Therefore, such a phenomenon occurs that the dielectric layer may be colored and air bubbles may occur. As a result, a problem occurs in that the PDP image quality may be deteriorated and poor insulation may occur in the dielectric layer.

Figure 5:
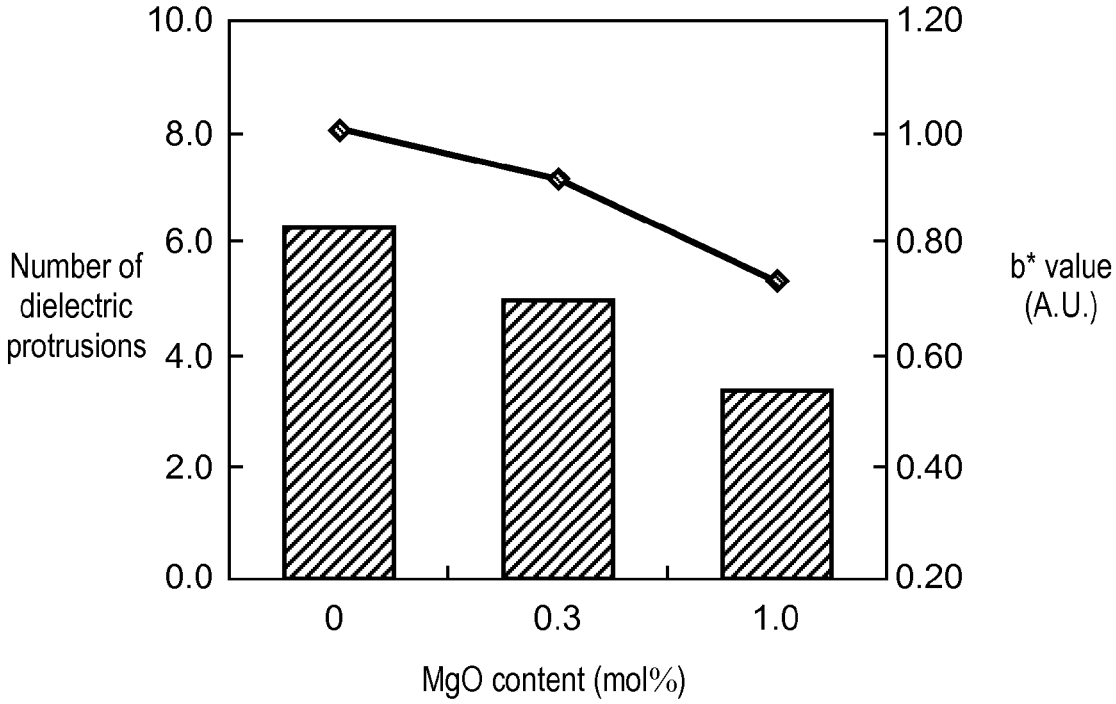
FIG. 5 is a graph showing changes in number of protrusions and degree of yellowing of the dielectric layer.

To solve the problems, MgO is contained in a range between 0.3 mol % and 1.0 mol %, both inclusive, in the present embodiment. MgO can inhibit air bubbles from occurring due to a binder component contained in the dielectric paste. Further, it is possible to improve an insulation quality of the dielectric layer and mitigate coloring of metal bus electrodes 4*b* and 5*b*. Those effects cannot be obtained if the content of MgO is less than 0.3 mol %. On the other hand, if the content of MgO is more than 1.0 mol %, deterioration in the total light transmittance of dielectric layer 8 occurs (hereinafter referred to as devitrification). FIG. 5 shows a result of measurement of the number of protrusions on the dielectric layer as a function of the content of MgO and a result of measurement of a degree of its yellowing. Three kinds of dielectric substances having different MgO contents were manufactured on a chip substrate having the metal bus electrodes formed on it through the same method as the aforesaid manufacturing method. The number of protrusions refers to the number of such protrusions as to have at least a constant diameter in a constant region after baking of the dielectric layer. As the degree of yellowing by silver (Ag), a b* value was measured using a chroma meter (CR-300 made by Minolta Co., Ltd.).

With this, it is found that as the MgO content increases, the number of protrusions on the dielectric layer changes and the b* value denoting the degree of yellowing decreases. It is to be noted that the b* value is based on a standard of a sample having 0 mol % of MgO.

If molybdenum (Mo) or tungsten (W) is added in order to inhibit occurrence of air bubbles, the dielectric layer may be devitrified in some cases.

Figure 6:
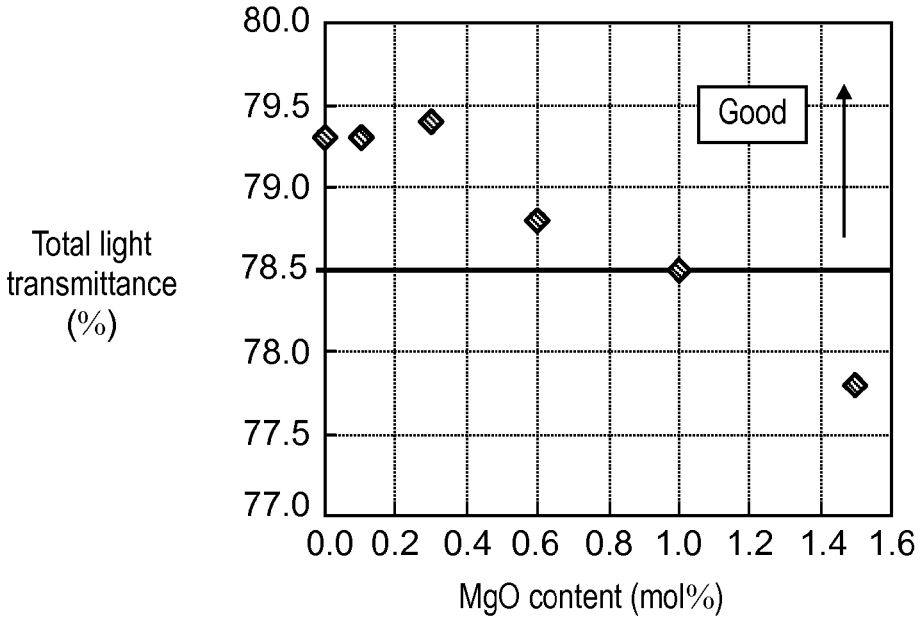
FIG. 6 is a graph showing a change in total light transmittance of the dielectric layer.

However, as shown in FIG. 6, even if MgO is added, the total light transmittance will not be reduced to less than 78.5% unless the MgO content exceeds 1.0 mol %. The total light transmittance of dielectric layer 8 in the PDP should preferably be at least 78.5%. If the total light transmittance is less than 78.5%, the luminance of the PDP deteriorates. Therefore, devitrification will be suppressed as long as the MgO content is 1.0 mol % or less. It is to be noted that in measurement of the total light transmittance, an HM-150 (made by Murakami Color Research Laboratory) was used. In the present embodiment, the total light transmittance refers to a transmittance of light having a wavelength of 550 nm incident in a direction perpendicular to front glass substrate 3 having dielectric layer 8 formed on it.

Dielectric layer 8 used in evaluation in FIGS. 5 and 6 has a composition of sample 2 shown in Table 1 described later. In this case, the composition of dielectric layer 8 was adjusted in such a manner that the sum of MgO and ZnO, which is also a divalent metal oxide like MgO, may be the same. Furthermore, the compositions stayed the same except for MgO and ZnO. Therefore, it is considered that the results shown in FIGS. 5 and 6 depend on a change in content of MgO.

It is to be noted that if dielectric layer 8 contains no Ca, its oxidization power as a dielectric layer deteriorates. This may result in insufficient firing of an organic material such as the binder component contained in the dielectric paste in some cases. In such a case, air bubbles may occur in the dielectric layer during its baking and remain as protrusions. However, in the present embodiment, MgO is contained in the range between 0.3 mol % and 1.0 mol %, both inclusive, so that poor insulation is inhibited in the dielectric layer.

3-4. $SiO_2$

In the present embodiment, $SiO_2$ is contained in a range between 35 mol % and 50 mol %, both inclusive. As a content of $SiO_2$ increases, breakdown strength of dielectric layer 8 increases. Hence, reliabilities of the PDP improve. Further, as the content of $SiO_2$ increases, a softening speed of the dielectric glass decreases. As a result, growth of air bubbles generated in dielectric layer 8 is suppressed. Hence, the quality of dielectric layer 8 improves more. It is to be noted that those effects cannot be obtained if the content of $SiO_2$ decreases less than 35 mol %. Further, if the content of $SiO_2$ exceeds 50 mol %, the baking temperature of dielectric layer 8 rises excessively, which is not preferable.

It is to be noted that the breakdown strength was evaluated by an iron ball dropping method. The breakdown strength refers to strength of dielectric layer 8 and front glass substrate 3 when dielectric layer 8 and barrier rib 14 have collided with each other. First, PDP 1 is horizontally placed in such a manner that front plate 2 may face upward. Next, an iron ball having a diameter of 10 mm is disposed at a predetermined height of over PDP 1. Next, the iron ball is dropped onto PDP 1. In a case where front plate 2 is not damaged even if the iron ball is dropped, the iron ball is disposed at a higher position. Again, the iron ball is dropped onto PDP 1. If front plate 2 is damaged as a result of dropping of the iron ball, the height where the iron ball is disposed in this case gives a breakdown height. The larger the breakdown height is, the higher the breakdown strength becomes.

3-5. Sample Preparation

Table 1 shows a composition ratio of each of the components of dielectric layer 8 in the present embodiment.

[Table 1]

Sample 1 contains $Bi_2O_3$. Sample 2 contains no $Bi_2O_3$. If no $Bi_2O_3$ is contained, the content of $B_2O_3$ increases.

TABLE 1

| Component | Sample 1 | Sample 2 |
|---|---|---|
| PbO | 0 | 0 |
| $B_2O_3$ | 25~35 | 35~50 |
| $SiO_2$ | 35~50 | 35~50 |
| $Al_2O_3$ | 0~1.0 | 0~1.0 |
| ZnO | 10~20 | 10~20 |
| MgO | 0.3~1.0 | 0.3~1.0 |
| $K_2O$ | 6~10 | 6~10 |
| $Bi_2O_3$ | 2~4 | 0 |
| $MoO_3$ | 0.5~1.0 | 0.5~1.0 |
| $Na_2O$ | 0.5~2.5 | 0.5~2.5 |
| CuO | 0~0.5 | 0~0.5 |
| CoO | 0~1.0 | 0~1.0 |

Unit: mol %

Dielectric glass powder is made by smashing a dielectric glass made of those composition components by using a wet jet mill or a ball mill into an average particle diameter of 0.5-3.0 micrometers. Next, 50-65% by weight of the dielectric glass powder and 35-50% by weight of the binder component are kneaded using three rolls. In such a manner, a dielectric paste is prepared for use in die coating or printing.

The binder component is terpineol or butyl carbitol acetate that contains ethyl cellulose or 1-20% by weight of an acrylic resin. Further, printing performance may be improved by adding dioctyl phthalate, dibutyl phthalate, triphenyl phosphate, tributyl phosphate as plasticizer and, as a disperser, glycerol monooleate, sorbitan sesquioleate, homogenol (product name, made by Kao Corporation), phospholic ester of alkyl allyl radical into the paste as required.

Next, the dielectric paste is printed by die coating or screen printing onto front glass substrate 3 in such a manner as to cover display electrode 6. Next, the printed dielectric paste is dried. Then, the dielectric paste is baked. The baking temperature is 575-590° C., a little higher than the softening point of the dielectric material. It is to be noted that the effect becomes remarkable in that as the film thickness of dielectric layer 8 decreases, the panel luminance improves and the discharge voltage decreases. Therefore, preferably the film thickness should be set smaller as long as the withstand voltage does not decrease. From viewpoints of such conditions and the visible light transmission, the film thickness of dielectric layer 8 is set to 41 micrometer or less in the present embodiment.

PDP 1 having dielectric layer 8 including samples 1 and 2 could meet the requirements to inhibit both yellowing and poor insulation in dielectric layer 8.

It is to be noted that values of the contents in the composition of the materials described above have an error in measurement of about ±0.05 mol % for the dielectric glass. The dielectric layer after being baked has a measurement error of about ±0.1 mol %. The same effects as the present embodiment can be obtained even with a material composition having the contents in a range of values containing those errors. Further, "substantially not to contain" lead, bismuth, barium, or calcium components means that lead, bismuth, barium, or calcium components of an impurity level may be contained.

INDUSTRIAL APPLICABILITY

The technologies disclosed in the present embodiment described above realize a PDP taking into account the environments and having high reliabilities and are well suited for application in a large-screen display device.

| REFERENCE MARKS IN THE DRAWINGS | |
|---|---|
| 1 | PDP |
| 2 | front plate |
| 3 | front glass substrate |
| 4 | scan electrode |
| 4a, 5a | transparent electrode |
| 4b, 5b | metal bus electrode |
| 5 | sustain electrode |
| 6 | display electrode |
| 7 | black stripe |
| 8 | dielectric layer |
| 9 | protective layer |
| 10 | rear plate |
| 11 | rear glass substrate |
| 12 | address electrode |
| 13 | base dielectric layer |

-continued

| REFERENCE MARKS IN THE DRAWINGS | |
|---|---|
| 14 | barrier rib |
| 15 | phosphor layer |
| 16 | discharge space |

The invention claimed is:

1. A plasma display panel comprising:

a front plate; and a rear plate confronting the front plate, wherein the front plate has a display electrode and a dielectric layer covering the display electrode, wherein the display electrode includes Ag, wherein the dielectric layer contains substantially no lead components but contains MgO, $SiO_2$, and $K_2O$, wherein a content of the MgO in the dielectric layer is in a range between 0.3 mol % and 1.0 mol %, both inclusive, and wherein a content of the $SiO_2$ in the dielectric layer is in a range between 35 mol % and 50 mol %, both inclusive.

2. The plasma display panel of claim 1, wherein a content of the $K_2O$ in the dielectric layer is not less than 6 mol %.

3. The plasma display panel of claim 1, wherein the dielectric layer further contains at least one of $Na_2O$ and $Li_2O$.

4. The plasma display panel of claim 2, wherein the dielectric layer further contains at least one of $Na_2O$ and $Li_2O$.

5. The plasma display panel of claim 3, wherein a content of the $Na_2O$ in the dielectric layer is not more than 3 mol %.

6. The plasma display panel of claim 4, wherein a content of the $Na_2O$ in the dielectric layer is not more than 3 mol %.

7. The plasma display panel of claim 1, wherein the dielectric layer contains substantially no barium components nor calcium components.

8. The plasma display panel of claim 1, wherein the dielectric layer contains substantially no bismuth components.

* * * * *